US012291381B1

(12) United States Patent
Barber

(10) Patent No.: US 12,291,381 B1
(45) Date of Patent: May 6, 2025

(54) LEASH SYSTEM FOR USE WITH A BEVERAGE CONTAINER LID

(71) Applicant: Todd Richard Barber, Wilmington, NC (US)

(72) Inventor: Todd Richard Barber, Wilmington, NC (US)

( * ) Notice: Subject to any disclaimer, the term of this patent is extended or adjusted under 35 U.S.C. 154(b) by 117 days.

(21) Appl. No.: 18/130,454

(22) Filed: Apr. 4, 2023

(51) Int. Cl.
*B65D 55/16* (2006.01)

(52) U.S. Cl.
CPC ..... *B65D 55/16* (2013.01)

(58) Field of Classification Search
CPC ..... B65D 55/16
USPC ..... 215/306
See application file for complete search history.

(56) References Cited

U.S. PATENT DOCUMENTS 1,041,816 A * 10/1912 Kopald ..... B65D 55/16 215/306
1,329,184 A * 1/1920 Hyams ..... F16N 3/04 222/538
1,430,843 A * 10/1922 Paull ..... B65D 35/42 220/292
1,924,242 A * 8/1933 Kaye ..... B65D 55/16 222/542
2,581,849 A * 1/1952 Fisch ..... B65D 35/42 220/288
2,789,717 A * 4/1957 Demke ..... B65D 55/16 215/320
3,306,483 A * 2/1967 Bellafiore ..... B65D 35/42 24/304
3,323,684 A * 6/1967 Furrer ..... A45F 3/16 210/474
3,874,570 A * 4/1975 Katzman ..... B65D 35/42 220/288
D243,062 S * 1/1977 Malloy ..... D8/382
4,339,056 A * 7/1982 Berkstresser, Jr. .... B65D 55/16 220/375
4,448,316 A * 5/1984 Hiroshige ..... B65D 77/283 215/229
4,534,483 A * 8/1985 Kassis ..... B65D 55/16 206/509
4,872,577 A 10/1989 Smith
5,102,002 A * 4/1992 Whitley ..... A47G 19/2205 220/823
5,150,808 A * 9/1992 Hamilton ..... B60K 15/0406 220/255
D356,260 S * 3/1995 Frank ..... D9/446
D356,469 S * 3/1995 Musilli ..... D3/202
5,415,774 A * 5/1995 Cowan ..... C02F 1/002 210/283

(Continued)

FOREIGN PATENT DOCUMENTS

WO 2011039395 7/2011

*Primary Examiner* — Ernesto A Grano
(74) *Attorney, Agent, or Firm* — Kyle A. Fletcher, Esq.

(57) ABSTRACT

The leash system for use with a beverage container lid includes an anchor, a leash, and a band. The leash system for use with a beverage container lid may be configured to tether a lid to a handleless beverage container. The anchor may be coupled to the lid. The leash may detachably couple to the handleless beverage container. An aperture located at a top end of the leash may detachably couple to an anchor tab on the anchor to prevent loss of the lid. A bottom end of the leash may be coupled to the band. The band may detachably couple to the handleless beverage container by encircling the handleless beverage container.

17 Claims, 5 Drawing Sheets

(56) References Cited

U.S. PATENT DOCUMENTS 5,518,136 A * 5/1996 Muldner ..... B65F 1/06 248/101
D377,146 S * 1/1997 Schmidiger ..... D9/499
5,752,687 A 5/1998 Lynch
5,765,716 A 6/1998 Cai
5,806,904 A * 9/1998 Smith ..... B65D 23/104 215/396
6,302,286 B1 * 10/2001 Witherspoon ..... A61J 11/008 215/11.1
6,370,701 B1 * 4/2002 Siegrist ..... A47K 11/12 4/144.1
6,409,220 B1 * 6/2002 Wing ..... A61M 1/60 285/133.11
6,478,180 B1 * 11/2002 Dehn, Sr. ..... B65D 47/061 215/276
6,622,356 B2 * 9/2003 Doshi ..... F16G 11/14 24/660
D514,432 S * 2/2006 McLaughlin ..... D8/356
7,073,686 B2 * 7/2006 Hanell ..... B67B 7/26 220/267
D541,943 S * 5/2007 Stewart ..... D24/199
7,467,650 B2 * 12/2008 Massey ..... B67D 3/04 285/8
D601,311 S * 9/2009 DeSeguirant, Jr. ..... D9/446
D605,942 S * 12/2009 Miksovsky ..... D9/446
D614,440 S * 4/2010 Cresswell ..... D7/392.1
7,748,579 B1 * 7/2010 Shin ..... B65D 83/06 222/548
8,245,870 B2 * 8/2012 McKinney ..... A47G 19/2266 220/703
D682,017 S * 5/2013 Smiedt ..... D9/446
8,695,842 B2 4/2014 Sanchez
8,733,584 B2 * 5/2014 Auzenne ..... B65D 39/0005 220/254.1
8,752,720 B1 * 6/2014 Habig ..... A47G 19/2266 220/375
8,783,487 B2 * 7/2014 Hojo ..... B65D 1/40 215/396
8,926,840 B2 * 1/2015 Hull ..... A47G 19/2272 220/709
D724,380 S * 3/2015 Hojo ..... D7/396.2
D753,998 S * 4/2016 Murphey ..... D9/446
9,493,283 B2 * 11/2016 Tuyn ..... B65D 55/16
D776,487 S 1/2017 Peeters
9,656,191 B2 * 5/2017 Hull ..... A47G 19/2266
D797,555 S * 9/2017 Carlson ..... D9/446
D806,893 S * 1/2018 Finley ..... D24/231
D809,060 S * 1/2018 Zhang ..... D19/194
D839,662 S * 2/2019 Jacobsen ..... D7/391
10,414,564 B2 * 9/2019 Shively ..... B65D 55/16
2004/0056040 A1 3/2004 Ziegler
2004/0164079 A1 * 8/2004 Alois ..... B65D 39/0005 220/375
2005/0109725 A1 * 5/2005 Stewart ..... A61J 11/008 215/11.6
2005/0199631 A1 * 9/2005 Alois ..... B65D 39/0005 220/375
2006/0016819 A1 * 1/2006 Paslawski ..... B65D 23/12 215/381
2006/0096987 A1 * 5/2006 Wry ..... B65D 55/16 220/780
2007/0199914 A1 * 8/2007 Hung ..... B65D 47/243 215/311
2008/0230545 A1 * 9/2008 Weene ..... B65D 25/20 29/700
2009/0001106 A1 * 1/2009 Massey ..... B67D 3/04 285/8
2009/0134112 A1 * 5/2009 Reeves ..... B65D 55/16 215/11.1
2009/0145915 A1 * 6/2009 Huff ..... B65D 55/16 220/744
2009/0194531 A1 * 8/2009 Branco ..... B65D 11/04 220/23.83
2009/0283047 A1 * 11/2009 Swenson ..... A01K 5/0114 119/61.5
2010/0170819 A1 * 7/2010 Skinner ..... G09F 23/06 206/459.5
2010/0206879 A1 8/2010 Lin
2016/0256359 A1 * 9/2016 Trawick ..... A61J 9/085
2017/0127859 A1 * 5/2017 Hornung ..... B65D 55/16
2018/0029762 A1 * 2/2018 Eyal ..... B65D 55/16
2018/0153288 A1 * 6/2018 Campbell ..... A45F 5/00
2019/0075973 A1 * 3/2019 Charleson ..... A47J 43/27

* cited by examiner

LEASH SYSTEM FOR USE WITH A BEVERAGE CONTAINER LID

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of beverage containers and tethering systems, more specifically, a leash system for use with a beverage container lid.

SUMMARY OF INVENTION

The leash system for use with a beverage container lid comprises an anchor, a leash, and a band. The leash system for use with a beverage container lid may be configured to tether a lid to a handleless beverage container. The anchor may be coupled to the lid. The leash may detachably couple to the handleless beverage container. An aperture located at a top end of the leash may detachably couple to an anchor tab on the anchor to prevent loss of the lid. A bottom end of the leash may be coupled to the band. The band may detachably couple to the handleless beverage container by encircling the handleless beverage container.

An object of the invention is to retain a lid to a beverage container.

Another object of the invention is to provide an anchor that couples to the lid of the beverage container.

A further object of the invention is to provide a leash that detachably couples to the beverage container via a band.

Yet another object of the invention is to provide a leash that detachably couples to an anchor tab located on the anchor.

These together with additional objects, features and advantages of the leash system for use with a beverage container lid will be readily apparent to those of ordinary skill in the art upon reading the following detailed description of the presently preferred, but nonetheless illustrative, embodiments when taken in conjunction with the accompanying drawings.

In this respect, before explaining the current embodiments of the leash system for use with a beverage container lid in detail, it is to be understood that the leash system for use with a beverage container lid is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the leash system for use with a beverage container lid.

It is therefore important that the claims be regarded as including such equivalent construction insofar as they do not depart from the spirit and scope of the leash system for use with a beverage container lid. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
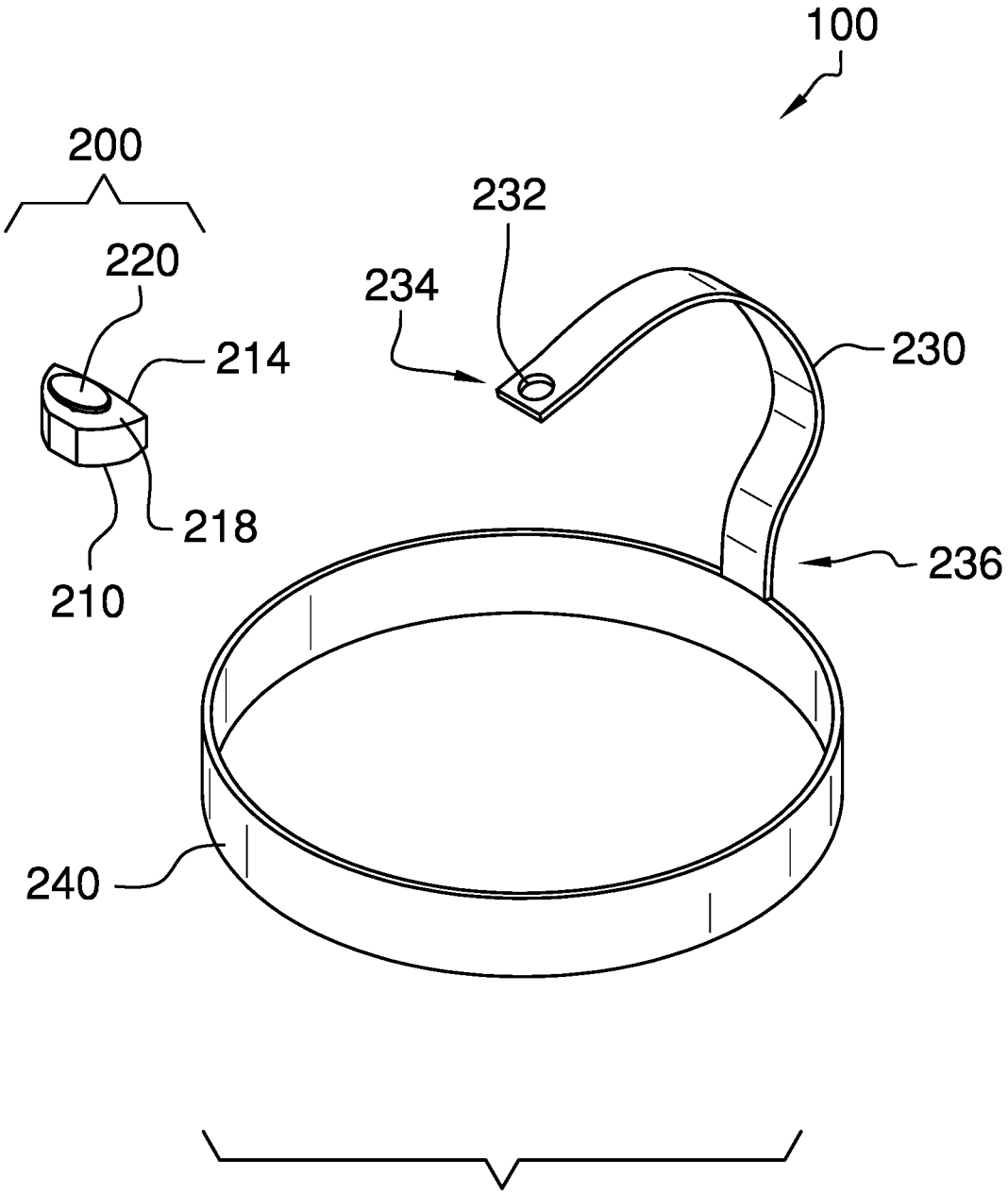
FIG. 1 is an isometric view of an embodiment of the disclosure.
Figure 2:
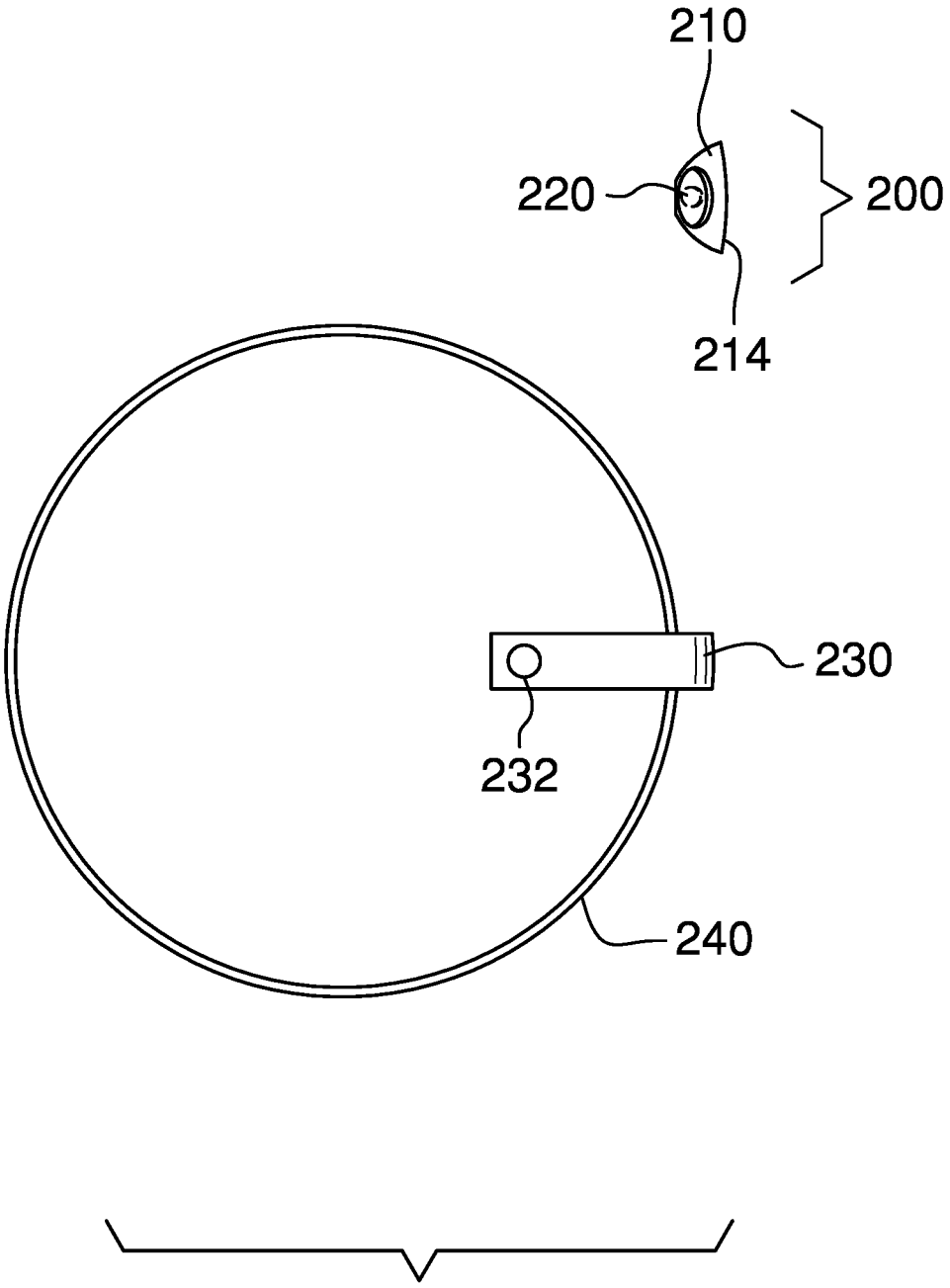
FIG. 2 is a top view of an embodiment of the disclosure.
Figure 3:
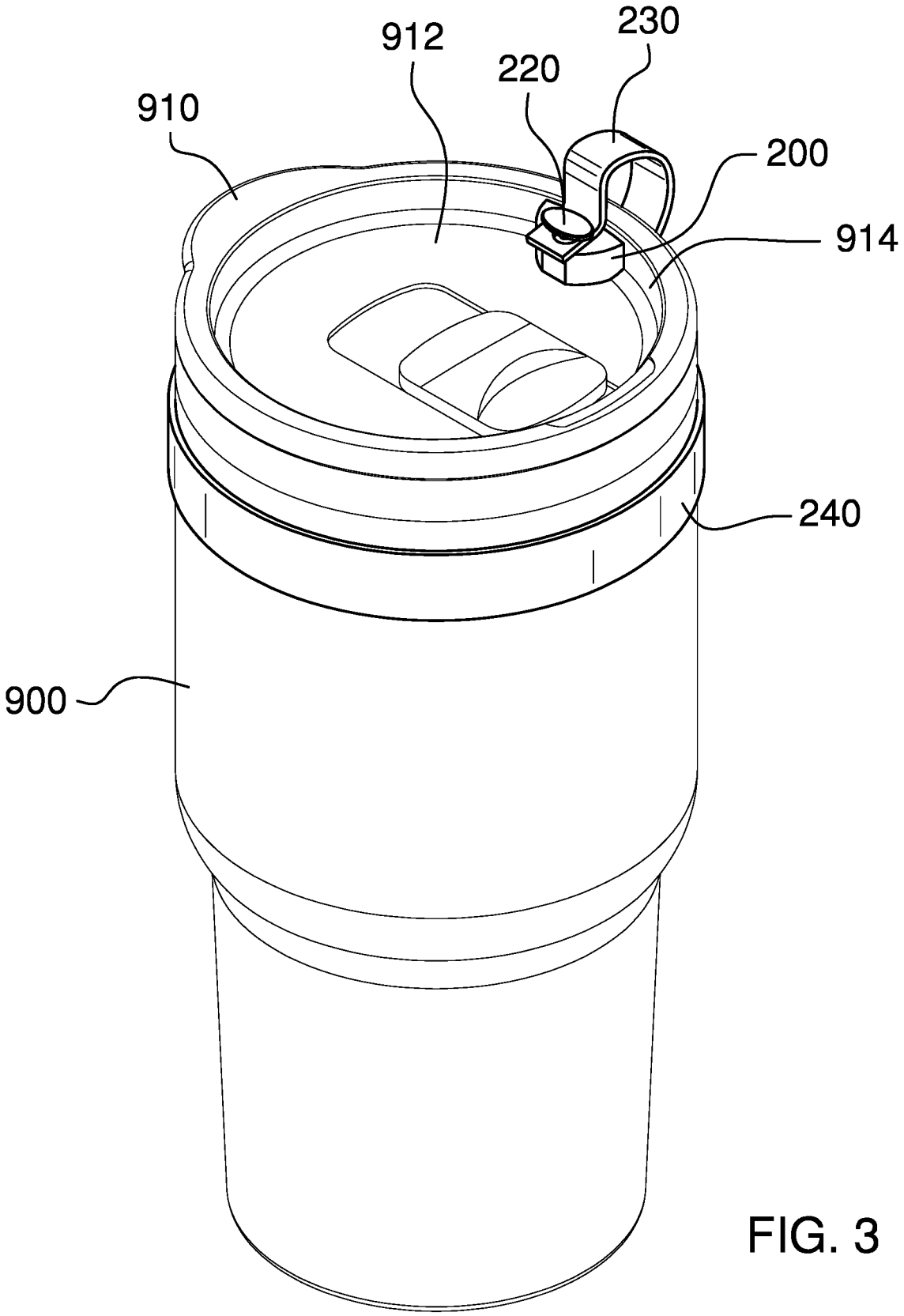
FIG. 3 is an in-use isometric view of an embodiment of the disclosure.
Figure 4:
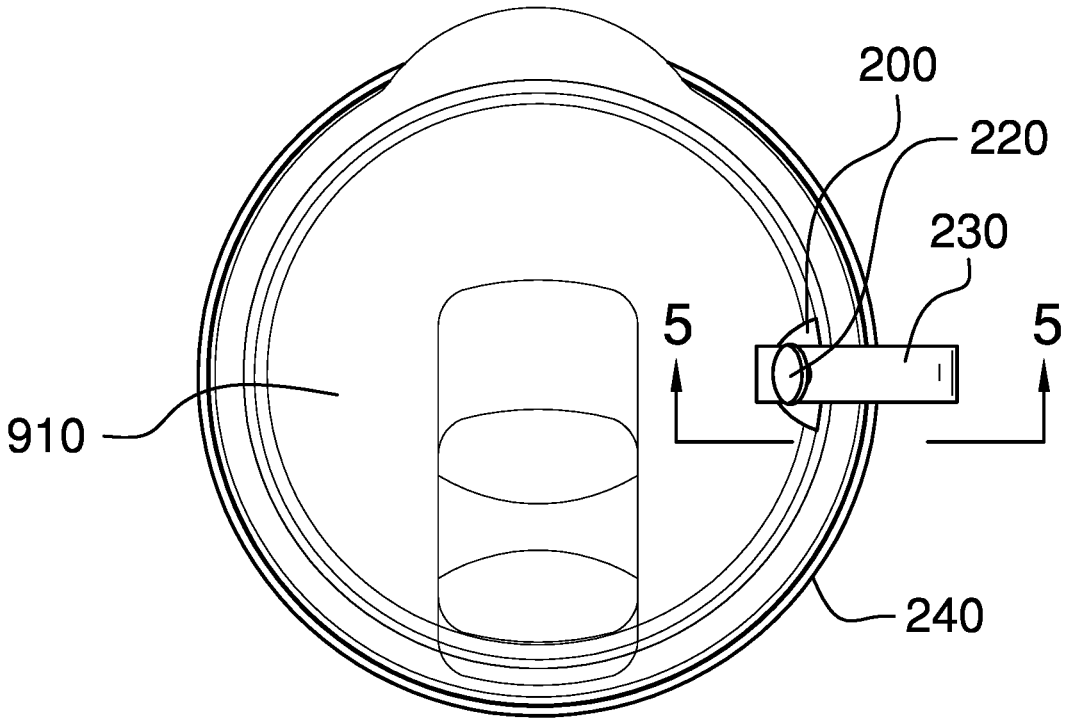
FIG. 4 is an in-use top view of an embodiment of the disclosure.
Figure 5:
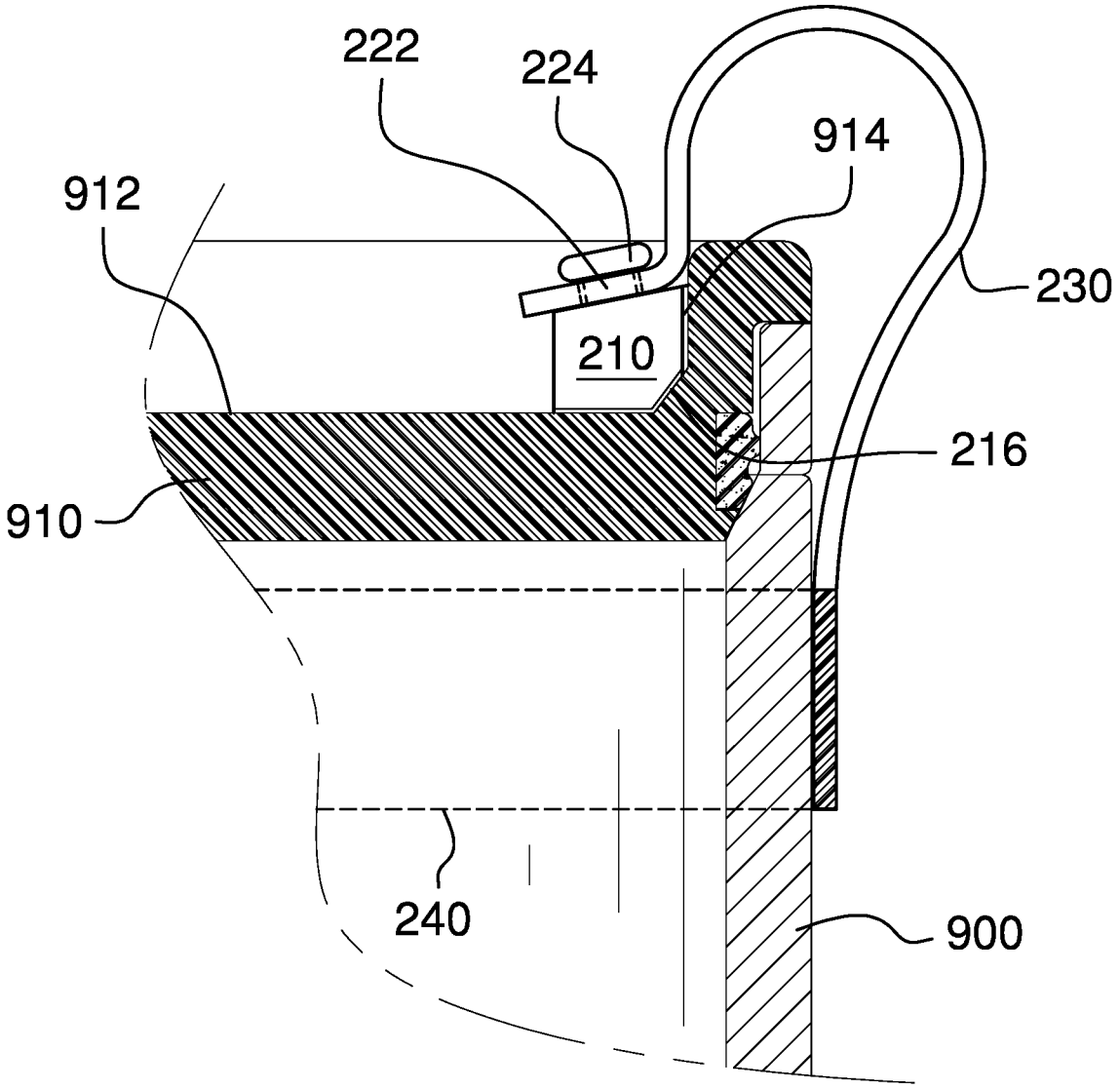
FIG. 5 is a cross-sectional view of an embodiment of the disclosure across 5-5 as shown in FIG. 4.

Detailed reference will now be made to a first potential embodiment of the disclosure, which is illustrated in FIGS. 1 through 5.

The leash system for use with a beverage container lid 100 (hereinafter invention) comprises an anchor 200, a leash 230, and a band 240. The invention 100 may be configured to tether a lid 910 to a handleless beverage container 900. The anchor 200 may be coupled to the lid 910. The leash 230 may detachably couple to the handleless beverage container 900. An aperture 232 located at a top end 234 of the leash 230 may detachably couple to an anchor tab 220 on the anchor 200 to prevent loss of the lid 910. A bottom end 236 of the leash 230 may be coupled to the band 240. The band 240 may detachably couple to the handleless beverage container 900 by encircling the handleless beverage container 900.

The anchor 200 may comprise an anchor base 210 and the anchor tab 220. The anchor base 210 may be coupled to a lid top surface 912 and positioned against a lid top interior side wall 914. The anchor base 210 may be coupled to the lid 910 via an adhesive applied between the lid 910 and the anchor base 210.

The anchor base 210 may comprise a flat bottom to conform to the shape of the lid top surface 912. The anchor base 210 may comprise a curved rear side 214 to conform to the shape of the lid top interior side wall 914. In some embodiments, the curved rear side 214 may comprise a beveled corner 216 to conform to the shape of the lid 910.

An anchor base top surface 218 may be canted such that the anchor base top surface 218 is lower closer to the center of the lid 910 and higher closer to outside edge of the lid 910. The cant of the anchor base top surface 218 may orient the anchor tab 220 such that coupling the leash 230 to the anchor tab 220 is made easier.

The anchor tab 220 may comprise a shaft 222 and a head 224. The anchor tab 220 may comprise a T-shaped profile as seen from the side. The anchor tab 220 may be operable to retain the top end 234 of the leash 230.

The shaft 222 may extend upwards from the top of the anchor base 210. The top of the shaft 222 may comprise the head 224. The shaft 222 may be cylindrical. The head 224 may be a thickening of the top of the shaft 222. The aperture 232 in the leash 230 may pass over the head 224 and onto the shaft 222. The head 224 may prevent the leash 230 from lifting off of the anchor tab 220. The head 224 may comprise an oval footprint as seen from above such that the leash 230 must be deformed in order to slide onto or off of the anchor tab 220.

The leash 230 may be a flexible strap that retains the lid to the handleless beverage container 900. The top end 234 of the leash 230 may comprise the aperture 232 that may detachably couple to the anchor tab 220 on the anchor 200. The aperture 232 may be round and may have a diameter that is larger than the diameter of the shaft 222 on the anchor tab 220 but smaller than the smallest diameter of the head 224 of the anchor tab 220. The bottom end 236 of the leash 230 may be coupled to the band 240. The band 240 may be a circular strap for encircling the upper half of the handleless beverage container 900. The band 240 may be elastic. The band 240 may be stretched to surround the handleless beverage container 900 and released to grip the handleless beverage container 900.

In a preferred embodiment, the width of the anchor base 210 may be ½ inch +/−1/16 inch. The depth of the anchor base 210 measured radially may be ¼ inch +/−1/16 inch. The maximum height of the anchor 200 as measured from the flat bottom to the top of the anchor tab 220 may be 3/16 inch +/−1/32 inch.

In use, an anchor 200 may be coupled to the lid 910 of the handleless beverage container 900 using an adhesive and the leash 230 may be coupled to the handleless beverage container 900 by placing the band 240 around the handleless beverage container 900. The top end 234 of the leash 230 may then be coupled to the anchor 200 by placing the aperture 232 at the top end 234 of the leash 230 over the anchor tab 220 on the anchor 200. The lid 910 tethered in this manner may be difficult to lose.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used in this disclosure, a "cant" may be an angular deviation from one or more reference planes such as a vertical plane or a horizontal plane.

As used herein, the words "couple", "couples", "coupled" or "coupling", may refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, "elastic" may refer to a material or object that deforms when a force is applied to stretch or compress the material and that returns to its relaxed shape after the force is removed. A material that exhibits these qualities is also referred to as an elastomeric material.

As used in this disclosure, "flexible" may refer to an object or material which will deform when a force is applied to it, which will not return to its original shape when the deforming force is removed, and which may not retain the deformed shape caused by the deforming force.

As used here, "footprint" may refer to a projection of an object onto the surface that supports the object. The projection is usually, but not always, vertically downward.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, the word "interior" may be used as a relational term that implies that an object is located or contained within the boundary of a structure or a space.

As used in this disclosure, a "lid" may be a movable or removable cover that is placed on a hollow structure to contain and/or protect the contents within the hollow structure.

As used in this disclosure, an "oval" may be a geometric shape that is formed in the shape of a flattened circle, similar in form to an ellipse. The shape may also sometimes be described as egg shaped. The difference between an oval and an ellipse is that an ellipse can be described by a mathematical formula while an oval has no such description.

As used in this disclosure, a "tab" may be an extension of an object for the purpose of facilitating the manipulation of the object, identifying the object, or attaching the object to another object.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A leash system in combination with a beverage container lid comprising:

an anchor, a leash, and a band;

wherein the leash system is configured to tether a beverage container lid to a handleless beverage container;

wherein the anchor is coupled to the beverage container lid;

wherein the leash detachably couples to the handleless beverage container;

wherein an aperture located at a top end of the leash detachably couples to an anchor tab on the anchor to prevent loss of the beverage container lid;

wherein a bottom end of the leash is coupled to the band;

wherein the band detachably couples to the handleless beverage container by encircling the handleless beverage container;

wherein the anchor comprises an anchor base and the anchor tab;

wherein the anchor base is coupled to a lid top surface and positioned against a lid top interior side wall;

wherein an anchor base top surface is canted such that the anchor base top surface is lower closer to a center of the beverage container lid and higher closer to an outside edge of the beverage container lid;

wherein the cant of the anchor base top surface orients the anchor tab such that coupling the leash to the anchor tab is made easier.

2. The leash system according to claim 1 wherein the anchor base is coupled to the beverage container lid via an adhesive applied between the beverage container lid and the anchor base.

3. The leash system according to claim 2 wherein the anchor base comprises a flat bottom to conform to the shape of the lid top surface.

4. The leash system according to claim 3 wherein the anchor base comprises a curved rear side to conform to the shape of the lid top interior side wall.

5. The leash system according to claim 4 wherein the curved rear side comprises a beveled corner to conform to the shape of the beverage container lid.

6. The leash system according to claim 5 wherein the anchor tab comprises a shaft and a head;

wherein the anchor tab comprises a T-shaped profile as seen from the side;

wherein the anchor tab is operable to retain the top end of the leash.

7. The leash system according to claim 6 wherein the shaft extends upwards from the top of the anchor base;

wherein the top of the shaft comprises the head.

8. The leash system according to claim 7 wherein the shaft is cylindrical.

9. The leash system according to claim 8 wherein the head is a thickening of the top of the shaft.

10. The leash system according to claim 9 wherein the aperture in the leash passes over the head and onto the shaft;

wherein the head prevents the leash from lifting off of the anchor tab.

11. The leash system according to claim 10 wherein the head comprises an oval footprint as seen from above such that the leash must be deformed in order to slide onto or off of the anchor tab.

12. The leash system according to claim 11 wherein the leash is a flexible strap that retains the beverage container lid to the handleless beverage container;

wherein the top end of the leash comprises the aperture that detachably couples to the anchor tab on the anchor.

13. The leash system according to claim 12 wherein the aperture is round and has a diameter that is larger than the diameter of the shaft on the anchor tab but smaller than the smallest diameter of the head of the anchor tab.

14. The leash system according to claim 13 wherein the bottom end of the leash is coupled to the band.

15. The leash system according to claim 14 wherein the band is a circular strap for encircling the upper half of the handleless beverage container.

16. The leash system according to claim 15 wherein the band is elastic.

17. The leash system according to claim 16 wherein the band is stretched to surround the handleless beverage container and released to grip the handleless beverage container.

* * * * *